United States Patent [19]

Ravinet et al.

[11] Patent Number: 4,535,205

[45] Date of Patent: Aug. 13, 1985

[54] ELECTROACOUSTIC TRANSDUCER OF THE PIEZOELECTRIC POLYMER TYPE

[75] Inventors: Pierre Ravinet; Christian Claudepierre; Denis Guillou; François Micheron, all of Paris, France

[73] Assignee: Thomson-CSF, Paris, France

[21] Appl. No.: 406,517

[22] Filed: Aug. 9, 1982

[30] Foreign Application Priority Data

Aug. 11, 1981 [FR] France ..... 81 15506

[51] Int. Cl.[3] ..... H04R 17/00

[52] U.S. Cl. ..... 179/110 A; 179/121 R

[58] Field of Search ..... 179/110 A, 180, 181 R, 179/140, 121 R, 115.5 PV; 367/162, 163, 165, 157; 181/167, 173; 310/800, 319

[56] References Cited

U.S. PATENT DOCUMENTS

| | | | |
|---|---|---|---|
| 3,903,733 | 9/1975 | Murayama et al. | 310/800 |
| 4,045,695 | 8/1977 | Itagaki et al. | 179/110 A |
| 4,056,742 | 11/1977 | Tibbetts | 310/357 |
| 4,064,375 | 12/1977 | Russell et al. | 179/110 A |
| 4,088,915 | 5/1978 | Kodama | 310/334 |
| 4,354,134 | 10/1982 | Micheron | 179/110 A |
| 4,401,911 | 8/1983 | Ravinet et al. | 179/110 A |

FOREIGN PATENT DOCUMENTS

| | | | |
|---|---|---|---|
| 0032082 | 7/1981 | European Pat. Off. | 179/110 A |
| 2714709 | 10/1977 | Fed. Rep. of Germany . | |

OTHER PUBLICATIONS

Japanese Journal of Applied Physics, "Bending Piezoelectricity in Polyvinilidene Flouride", L. Breger, vol. 15, No. 11, 1976, pp. 2239–2240.

Electronics Letters, "Noise-Cancelling Microphone Using a Piezoelectric Plastics Transducing Element", J. F. Sear Oct. 30, 1975 pp. 532–533.

*Primary Examiner*—Gene Z. Rubinson
*Assistant Examiner*—Danita R. Byrd
*Attorney, Agent, or Firm*—Cushman, Darby & Cushman

[57] ABSTRACT

In a piezoelectric microphone or hydrophone, the elastic structure which reacts directly to the acoustic pressure is formed of piezoelectric polymer. The electroacoustic transducer according to the invention makes use of an elastic structure in the form of a rim clamped plate having at least one incurvation and covered on at least one of its two faces with electrodes connected to an impedance-matching circuit.

14 Claims, 16 Drawing Figures

FIG. 3
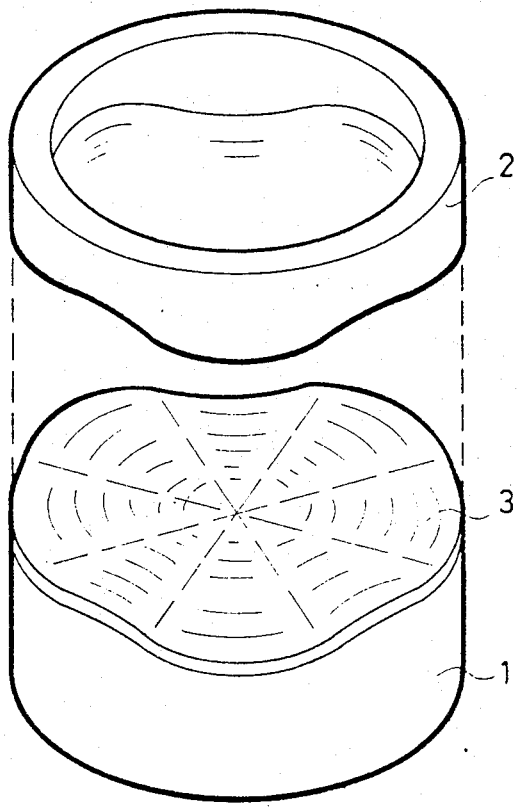
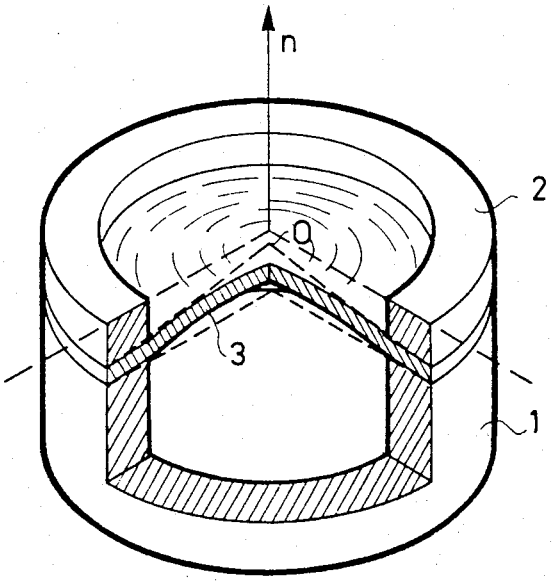
FIG. 4

ELECTROACOUSTIC TRANSDUCER OF THE PIEZOELECTRIC POLYMER TYPE

This invention relates to electroacoustic transducers for converting an acoustic pressure or a pressure gradient to a voltage. The invention is more particularly concerned with pressure or velocity microphones and hydrophones in which the conversion of an acoustic vibration to a voltage is carried out by means of a vibrating element of piezoelectric polymer.

It is already known to construct microphones of the type in which the diaphragm is formed by a stretched or thermoformed piezoelectric polymer membrane. In particular, it is a common practice to utilize a thin film of polyvinylidene fluoride ($PVF_2$) having a thickness of the order of fifteen microns in order to form a transducer element which is subjected to deformation under the action of a pressure difference produced between its faces. The pressure difference is obtained by mounting the piezoelectric diaphragm in a screen. In order to obtain sensitivity to the acoustic pressure, however, the screen is replaced by an enclosed casing. The piezoelectric element forms an electric capacitor whose capacitance varies inversely with the thickness of film employed. The piezoelectric transducer effect applies to the electrodes an electric charge which is induced by the mechanical stresses sustained by the piezoelectric film. On open circuit, the voltage induced by piezoelectric effect varies inversely with the interelectrode capacitance. In the case of a thin film, it is consequently necessary to produce a substantial deformation in order to obtain good sensitivity. A thin membrane has high mechanical compliance but the fact of closing the rear face introduces an acoustic capacitance which reduces the compliance of the assembly to an appreciable degree. In order to reduce the load effect produced on the diaphragm by the air cushion to be compressed, the volume of the casing can be reduced but this solution is often unacceptable by reason of the resultant overall size of the microphone.

When a flat diaphragm made of a single layer of piezoelectric material is used as a vibrating element, the predominant deformation energy is that which corresponds to traction-compression and since this stress does not undergo any change of sign with the alternating acoustic pressure, the greater part of the voltage delivered is accordingly rectified. In order to use a diaphragm of this type, mechanical polarization can be provided by producing an overpressure within the diaphragm support casing. This overpressure can be obtained by means of an elastic sound cushion. Double-frequency operation can be prevented by using a bimorph structure as a vibrating element, which complicates the fabrication of diaphragms but avoids any need for prestressing. Finally, use can be made of a thermoformed diaphragm in the shape of a protuberance but this gives rise to difficulties in regard to both fabrication and dimensional stability.

The aim of the invention is to overcome these drawbacks while retaining a structure which is particularly simple to produce owing to the use of a vibrating plate instead of a membrane.

It is an object of the present invention to provide an electroacoustic transducer of the piezoelectric polymer type in which the vibrating element is constituted by an elastic structure of piezoelectric polymer which is subjected directly to the acoustic pressure on at least one of its faces. The faces of said structure are fitted with electrodes forming a capacitor, said electrodes being connected to an impedance-matching electric circuit whilst said elastic structure and said electric circuit are mounted within a casing provided with one pair of output terminals. The distinctive feature of the invention lies in the fact that said elastic structure is a rim clamped plate having at least one incurvation.

Other features of the invention will be more apparent upon consideration of the following description and accompanying drawings, wherein:

FIG. 3 illustrates a first embodiment of a microphone unit according to the invention;

FIG. 4 illustrates a second embodiment of a microphone unit according to the invention;

Figure 1:
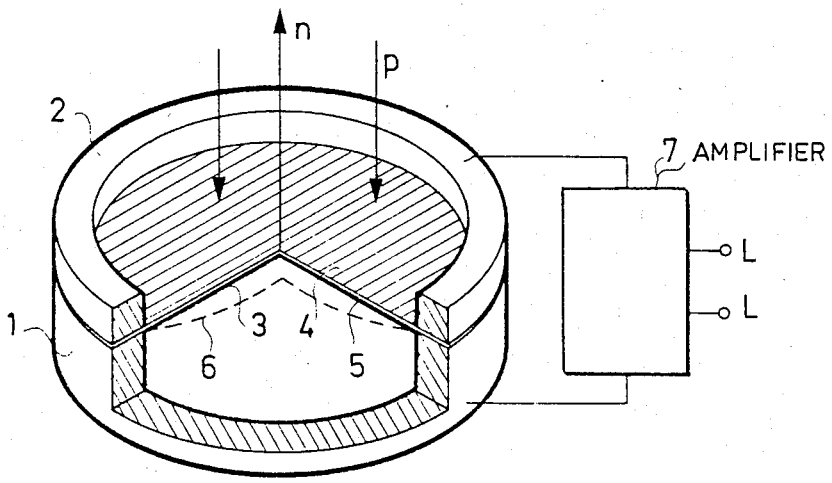
FIG. 1 (PRIOR ART)
FIG. 1 illustrates a microphone unit of known type.

In FIG. 1, there is shown a microphone unit in which provision is made for a diaphragm of piezoelectric polymer in accordance with the prior art. Said unit is composed of a casing in two parts comprising a base 1 and an annular collar 2. A diaphragm 3 formed by a membrane or thin film of piezoelectric polymer is pinched between the annular collar 2 and the rim of the casing base 1. The diaphragm 3 is subjected to the acoustic pressure p and compresses the closed internal space of the casing base 1 as said diaphragm undergoes deformation. In other words, the acoustic pressure on the diaphragm causes a reduction in the volume of the closed internal space. If said internal space is filled with air at atmospheric pressure, an overpressure $\Delta p$ produces the sag shown in dashed outline in FIG. 1. In the case of a film having a thickness of 15 microns and a diaphragm diameter of 15 millimeters, the extent of deformation of the diaphragm is governed by the tensile stresses, the vertical component of which must balance the thrust. Electrodes 4 and 5 which cover both faces of the diaphragm 3 serve to collect electric charges induced by the intrinsic piezoelectricity of the film 3. An amplifier circuit 7 collects a voltage which is proportional to the charges and inversely proportional to the apparent dielectric constant of the diaphragm-electrode assembly. The circuit 7 has a very high input impedance and its output impedance is matched with the impedance of the transmission line LL. In the presence of an alternating acoustic pressure, the device of FIG. 1 delivers a rectified voltage but the response can be linearized by applying a prestress to the diaphragm 3.

Figure 2:
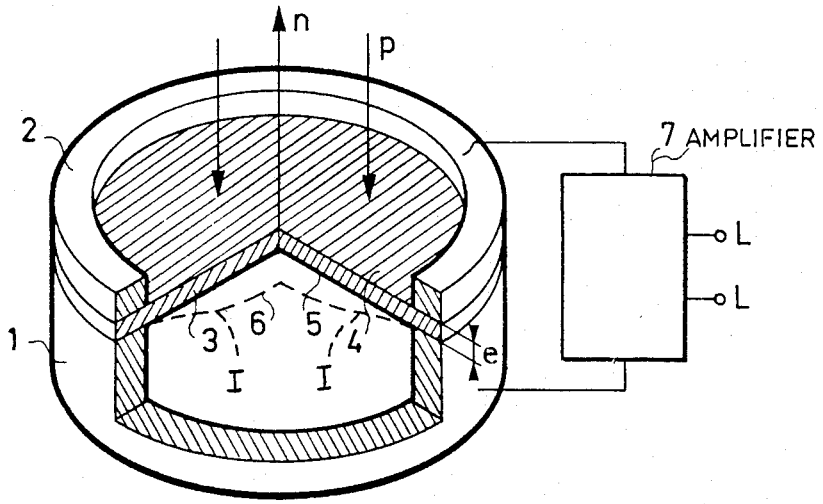
FIG. 2 illustrates a microphone unit with a vibrating element in the form of a rim clamped plate.

The structure of the microphone unit as shown in FIG. 2 differs from the structure of FIG. 1 only in the use of a rim clamped plate 3 having a thickness e instead of a diaphragm. Although this difference may appear to be trivial, the resultant operation of the piezoelectric transducer is nevertheless appreciably different.

In contrast to a diaphragm of the thin membrane type, a plate has a bending stiffness or rigidity which is added to the tensile strength in order to compensate for the thrust exerted by the pressure p. When the plate is of the rim clamped type, the curvature is reversed, on each side of the sag 6 at inflection points I as shown in FIG. 2, upon aplication of pressure to one face of the rigid plate. The deformation work is composed of a number of terms involving the tensile stress, the bending moment and the shearing stress. Generally speaking, the mechanical compliance of a plate is smaller than that of a membrane, thus making this structure of substantial thickness less sensitive to the presence of an enclosed internal space to be compressed.

The intrinsic piezoelectricity makes it possible to compute the electric charge induced by stretching of the plate in its plane but does not serve to determine the electric charges induced by bending. A substantial proportion of the induced electric charge can be determined, however, by means of flexural piezoelectricity or in other words piezoelectricity which is evaluated on the basis of a stress gradient. When an alternating acoustic pressure excites a flat plate, the stress gradient undergoes a change of sign at each half-cycle, with the result that the voltage developed between the electrodes 4 and 5 contains an alternating-current component and that there is no need to apply a prestress. In respect of an equal induced electric charge, the open-circuit voltage developed by a piezoelectric plate is higher than the voltage which would be produced by a diaphragm since the electrical capacitance is of lower value. It is for this reason that, while having a lower value of compliance, a plate is capable of offering a suitable degree of voltage sensitivity and lower distortion by virtue of the linearizing action of flexural piezoelectricity.

The foregoing considerations have led to experimentation on the microphonic properties of the device shown in FIG. 2 by utilizing plates of polyvinylidene fluoride ($PVF_2$) of increasing thickness (e).

Figure 8:
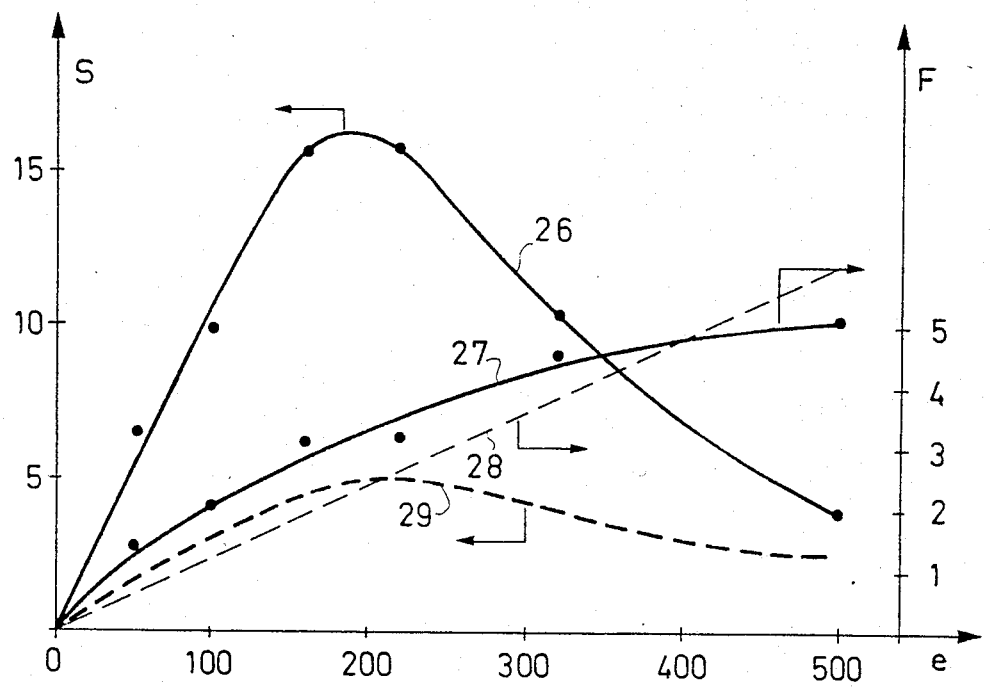
FIGS. 8 and 9 are explanatory diagrams.

In the case of a plate of piezoelectric polymer $PVF_2$ having a diameter of 15 mm exclusive of the clamped edge, the diagram of FIG. 8 gives the sensitivity S in millivolts per Pascal and the lowest resonant frequency F in kHz in respect of different thicknesses e expressed in microns.

Curves 28 and 29 (see FIG. 8) relate to a rim clamped plate of flat shape. Curve 28 shows that the resonant frequency increases linearly with the thickness e of the vibrating plate, which is typical of a structure endowed with bending resistance. Curve 29 shows that the voltage sensitivity increases with the thickness e up to 200 microns and then falls off in respect of greater thicknesses. The measurement of sensitivity is carried out distinctly below the resonant frequency, thereby making the mass effect of the vibrating plate negligible and devoting attention to static deformation. The frequency F must be considered as illustrative of the frequency band which can be faithfully reproduced. Thus the curve 29 shows that, up to a thickness of 200 microns, the sensitivity and the passband increase simultaneously whereas a phenomenon which is common in acoustics is observed, namely the fact that the gain achieved on the passband is obtained at the expense of sensitivity.

The use of a flat rim clamped plate as a transducer element which is directly subjected to the acoustic pressure is of considerable interest from the point of view of convenience of manufacture and time stability of characteristics. In practice, however, the concept of surface flatness and of clamping are approximations which can have a great influence on reproducibility of characteristics of a microphone. A small defect of surface flatness which changes from one sample to the next produces a considerable dispersion of sensitivity to such an extent that, when it is sought to achieve maximum surface flatness of a plate, a veritable collapse of sensitivity has been observed.

Instead of regarding the sensitivity of a microphone as a matter of empirical choice, the present invention contemplates the systematic formation of a slight incurvation of the plate, thus compensating for all defects of surface flatness which are inherent to the manufacturing process.

FIG. 3 is an exploded view in isometric perspective and illustrates a microphone unit according to the invention. The piezoelectric plate 3 is provided with sectoral undulations by clamping said plate between the wavy faces of the annular collar 2 and the rim of the casing base 3. In comparison with insetting by clamping a plate having maximum surface flatness between two flat annular bearing surfaces, an appreciable gain in sensitivity is observed and can attain a value of 20 dB. After removal and re-positioning of the plate 3 in this insetting assembly of the undulated type, it is found that good reproducibility of characteristics of the microphone unit is achieved. The undulations of the plate 3 have a favorable incidence on the response to tensile/-compressive stresses, the action of which is added to the flexural stresses. In fact, the incurvation of the plate forms a slightly stiffened bow shaped structure which reacts linearly to the alternating acoustic pressure.

In order to form the wavy clamping surfaces of the clamped-edge joint, it is necessary to carry out accurate machining of the annular collar 2 and of the casing base 1.

In order to simplify the machining operation, FIG. 4 shows a partial isometric view of another embodiment of the invention. The microphone unit which is illustrated makes use of a plate 3 which is partially convex by virtue of a slightly conical clamped-edge joint. To this end, the annular surfaces of the annular collar 2 and of the casing base 1 which serve to clamp the plate 3 are portions of coaxial cones such that the apex angle 0 has a value of slightly less than 180°. In the case of an apex angle of 166° and a plate having a thickness of 200 microns and rim clamped to a diameter of 15 mm, a sensitivity of 3.5 millivolts per Pascal has been obtained.

It is apparent from the foregoing that the sensitivity of a piezoelectric plate is highly dependent on small defects of surface flatness which are perceptible when the metallized faces are examined by reflection. This slight buckling effect may arise from internal stresses which can be relieved by means of a suitable heat treatment. However, higher sensitivity and good reproducibility of the response curve can be obtained by subjecting the rim clamped plate to deformations exceeding the random deformations arising from imperfect assembly or from a lack of initial surface flatness. Mounting of an initially flat plate in a frusto-conical clamped-edge joint tends to endow said plate with a domical shape which is dependent on the flexural rigidity. This shape calls for neither a preliminary forming operation nor application of the plate against an elastic medium having the intended function of producing a raised portion or boss.

Curves 26 and 27 of the diagram of FIG. 8 have been obtained by means of a frusto-conical edge-clamping joint surface having an apex angle of 160°. Curve 26 shows that the voltage sensitivity is distinctly higher than that obtained with a flat edge-clamping joint surface. Curve 27 shows that the frequency of the first resonant mode is increased except in the case of substantial thicknesses. The optimum thickness for a plate of polyvinylidene fluoride having an internal diameter of 15 mm is in the vicinity of 200 microns.

Figure 9:
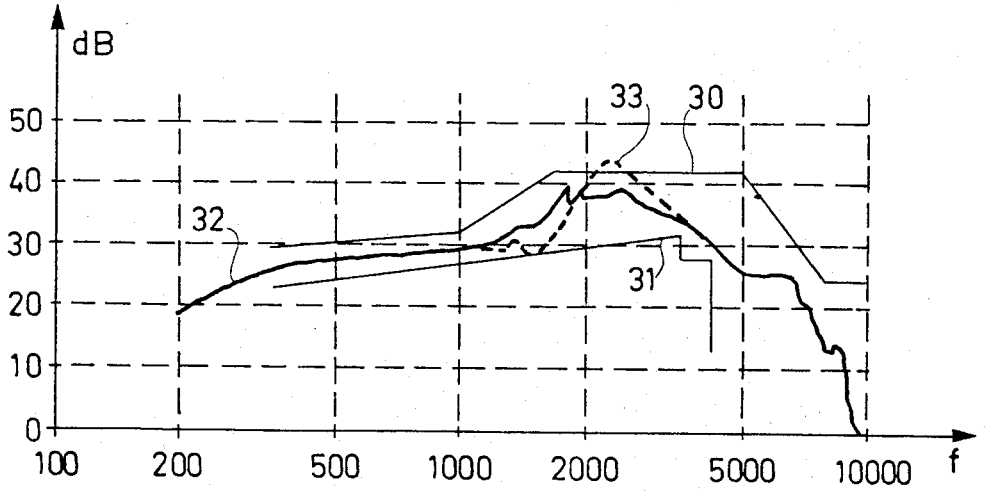

FIG. 9 illustrates the frequency response curve of a microphone unit having a vibrating plate 200 microns in thickness. The profiles 30 and 31 delimit the outline of a microphone for telephone service. The response curve 32 has been obtained with acoustic damping of the first plate resonance. The dashed portion of curve 33 shows the difference in shape when acoustic damping is not employed.

Figure 5:
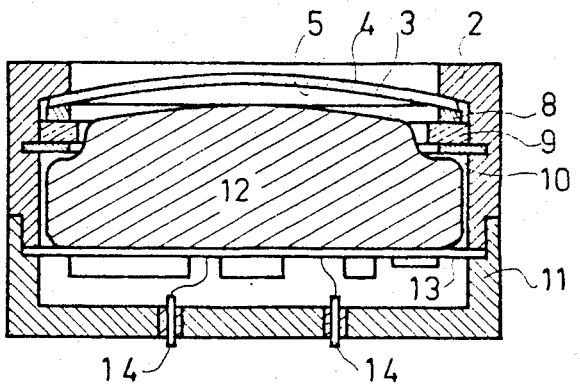
FIG. 5 is a central sectional view of a microphone according to the invention.

FIG. 5 is a central sectional view of a microphone unit of the piezoelectric plate type. The casing consists of an upper portion 2 of metal which engages within a base 11 fitted with insulated connection terminals 14. The piezoelectric plate 3 provided with its metallizations 4 and 5 is rim clamped in a frusto-conical recess between the flange of the upper portion 2 of the casing and a metallic ring 8 having a trapezoidal cross-section. The ring 8 is pressed against the plate 3 by means of an insulating washer 9 which rests on a resilient locking member 10 and this latter is adapted to penetrate into a circular slot of the upper portion 2 of the casing. A pad 12 of sound-absorbing material is housed within the central space of the upper portion 2 of the casing. The pad is wedged between the member 9 and a printed-circuit base 13 on which are arranged the electronic components of an impedance-matching circuit.

The piezoelectric polymer materials such as polyvinylidene fluoride and its copolymers are particularly suitable since they readily permit the formation of incurvations as illustrated in FIGS. 3 to 5. In regard to the passband, the upper limit can be defined as a first approximation from a calculation of the frequency $f_1$ of the first resonant mode of a circular plate as follows:

$$f_1 = \frac{2.96}{2\pi} \cdot \frac{e}{R^2} \sqrt{\frac{E}{\rho(1-\nu^2)}}$$

where
e is the thickness of the plate
R is the internal radius of the non-clamped circle
E is the Young modulus of the piezoelectric material
$\nu$ is the Poisson coefficient
$\rho$ is the specific volume.

In the case of a plate of $PVF_2$, we have:
$E=3.5\times10^9$ N m$^{-2}$
$\nu=0.3$
$\rho=1.8\times10^3$ Kg m$^{-3}$
with R=0.75 cm and e=200 microns, we find:
$f_2=2.45$ kHz.

By damping this resonance peak with a foam cushion applied against the rear face of the plate, an upper limit of the order of 3.6 kHz can be attained as illustrated in FIG. 9.

The lower limit of the passband is zero if the capacitance constituted by the plate is connected to an amplifier circuit having an infinite input impedance.

However, it is found desirable in practice to attenuate the response below a frequency $f_2$ and in this case a resistor $R_e$ must be connected in parallel to the capacitor C of the plate. The following relation is accordingly applied:

$$R_e C = \frac{1}{2\pi f_2}$$

If $f_2$ is equal for example to 300 Hz and if the electrodes have a diameter of 15 mm and are separated by a thickness of 225 microns of $PVF_2$, and knowing that $\epsilon_r\epsilon_o=10^{-10}$ F.m$^{-1}$, we find:

$$C = \frac{\pi}{4} \times 10^{-10} \times \frac{225\times10^{-6}}{225\times10^{-6}} \doteq 80 \text{ pF}$$

and $$R_e \doteq \frac{1}{9\times10^{-11}\times2\pi\times300} = 6\times10^6 \text{ ohm}$$

The amplifier circuit to be mounted downstream of the microphone unit must be capable for example of delivering a voltage gain which is close to unity and, in order to deliver to an external impedance of 200 ohms, said circuit must provide a current gain equal to $(6\times10^6)/200=3\times10^4$.

Figure 6:
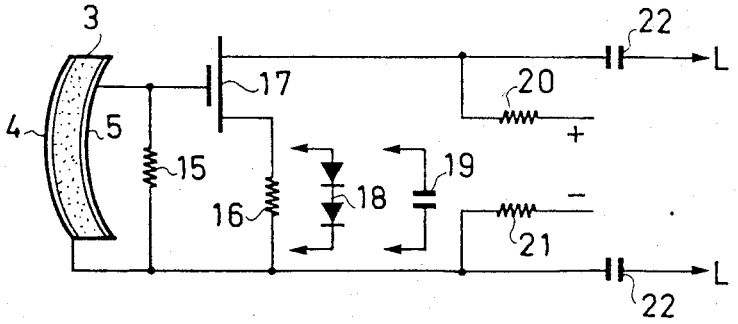
FIGS. 6 and 7 are electrical diagrams of impedance-matching circuits.

In FIG. 6, there is shown an electric circuit for establishing a connection between the microphone unit 3, 4, 5 and a telephone line LL. This circuit makes use of an insulated-gate unipolar transistor 17. The source of the transistor 17 is connected through a bias resistor 16 to the ground electrode 4. A diode limiter 18 and a decoupling capacitor 19 can be connected in parallel to the resistor in order to apply a suitable bias to the gate of the transistor 17. As mentioned earlier, the resistor 15 which is connected in parallel to the microphone unit 3, 4, 5 determines the bottom cutoff frequency $f_2$. The load resistors 20 and 21 connect respectively the positive and negative poles of a supply source to the electrode 4 and to the drain of the transistor 17. Decoupling capacitors 22 prevent the direct-current component from being transmitted to the line LL.

Figure 7:
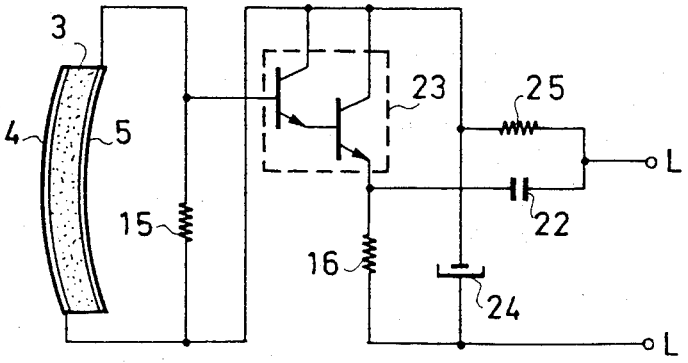

The impedance-matching circuit can be constructed by means of bipolar transistors as illustrated in the electrical diagram of FIG. 7. The transmission line LL can deliver the supply voltage to the amplifier stage via a resistor 25 connected to a filter capacitor 24. The amplifier stage comprises a Darlington circuit 23 consisting of two npn transistors and employed as an emitter-follower. The resistor 16 performs the function of emitter load and is connected to the transmission line LL via a coupling capacitor 22. Current bias of the Darlington circuit is obtained by means of a high-resistance resistor 15 which connects the base of the first npn transistor of the circuit 23 to the positive pole of the capacitor 24. The microphone unit 3, 4, 5 proper is connected in parallel with the resistor 15.

Figure 10:
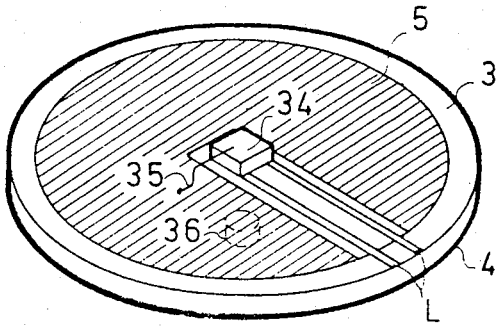
FIGS. 10 to 12 illustrate constructional details of the plate-type transducer element.

FIG. 10 is an isometric view of a piezoelectric microphone-unit plate according to the invention. Consideration is given in this instance to an integrated construction in which the plate of polyvinylidene fluoride serves as a support for an integrated circuit 34 in which the elements 22, 23, 25 and 16 of FIG. 7 are grouped together. The metallization 5 is grooved and two connecting strips L are provided for connection to the transmission line. The capacitor 24 is connected externally to one of said connecting strips and to the counter-electrode 4. The resistor 15 is designed in the form of a dielectric filling 36 which is endowed with low electrical conductivity. The lead 35 serves to connect the electrode 5 to the base lead of the Darlington circuit 23.

Figure 11:
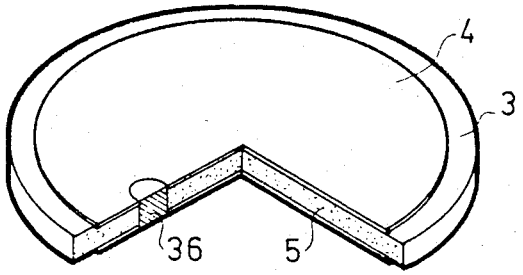

FIG. 11 is a partial and reversed isometric view of the piezoelectric plate of FIG. 10. It is apparent that the construction of the resistor connected between the electrodes 4 and 5 is obtained by drilling a hole 36 and by packing this latter with conductive polymer obtained by means of a carbon filler, for example.

Figure 12:
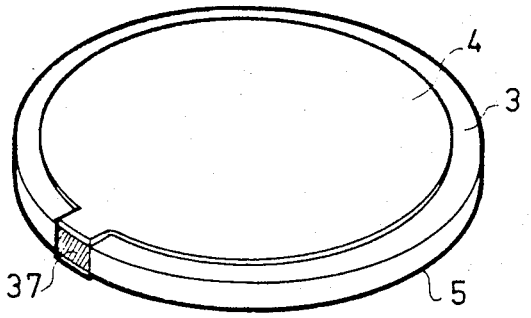

FIG. 12 shows that the resistor for connecting the electrodes 4 and 5 can be materialized by a deposit 37 which has low conductivity and occupies either all or part of the edge of the piezoelectric plate 3.

Finally, it should be pointed out that the bleeder resistor 15 shown in the electrical diagrams of FIGS. 6 and 7 can be obtained by doping the piezoelectric polymer throughout its mass. Doping can be effected by ion diffusion or by mixing traces of potassium iodide with a polymer solution. The advantage of this technique lies in the fact that the time constant is intrinsically defined and therefore independent of the geometrical shape of the plate.

It is worthy of note that the overloading constituted by the presence of the integrated circuit 34 is of low value compared with the effective mass of the vibrating plate and that the corresponding drop in resonant frequency is insignificant.

In regard to the fabrication of the electrodes 4 and 5, it is possible to adopt the technique of vacuum evaporation of metals such as aluminum, chromium-nickel, gold-chromium. The circular plates can be cut-out by a punch press from a sheet which has been metallized on both faces. On account of the high impedances encountered at the input of the impedance marching circuit. there is no objection to the fabrication of the electrodes 4 and 5 in the form of thin films of polymer filled with conductive particles. These particles can be of metal such as nickel, copper-silver alloy or silver, for example, but carbon particles may also be employed. The polymer which is used as a binder can be different from the piezoelectric polymer and may accordingly consist, for example, of latex, silicones, synthetic or natural rubber. It also proves advantageous to make use of the same polymer as a binder. Thus, in order to fabricate the electrodes of a polyvinylidene fluoride plate, there can be employed a starting solution of 20 gr/liter in dimethylformamide to which is added 20% by weight of carbon black known as Corax L (produced by the Degussa Company). A conductive deposit of this type offers excellent adhesion with $PVF_2$ and wholly sufficient electrical conductivity. Depositions by screen process, turntable, brush and spray process can be employed. Drying takes place at a temperature above 70° C. in order to prevent formation of a powdery deposit.

Figure 13:
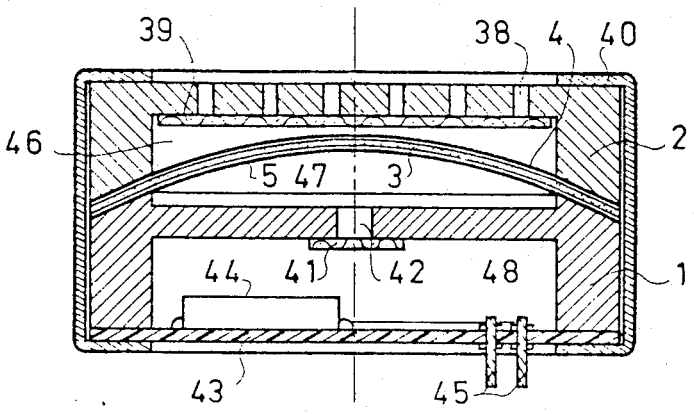
FIG. 13 is a central sectional view of another microphone according to the invention.

FIG. 13 is a central sectional view showing a microphone unit which is particularly simple to construct.

Figure 15:
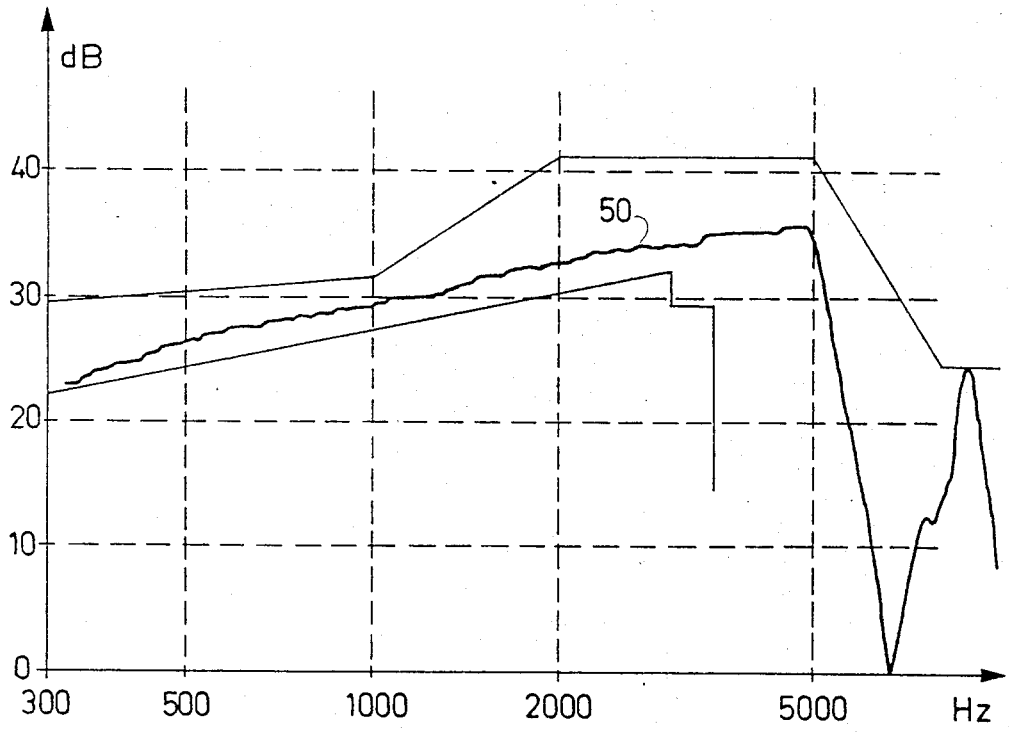
FIG. 15 is an explanatory diagram.

This unit comprises two metallic support frames 1 and 2 having frusto-conical rims which serve to clamp the edge of a plate 3 of piezoelectric polymer so as to provide this latter with a domical shape. The upper support frame 2 is in contact with a conductive deposit 4 on the convex face of the plate 3. Said upper frame performs the function of a cover and accordingly forms a cavity 46 which communicates with the exterior through a series of orifices 38 pierced in the end-wall of said frame. A damping disk 39 of textile fabric is bonded to the bottom wall of the cavity 46. The external acoustic pressure therefore produces action on the convex face of the plate 3 via the orifices 38 and the damping layer or disk 39. The concave face of the plate 3 is covered with a conductive deposit 5 which is in contact with the top rim of the support frame 1. The frame 1 has an internal wall pierced by an orifice 42 which establishes a communication between two cavities 47 and 48. A damping pad 41 of textile fabric is bonded in position against the orifice 42. The cavity 47 is delimited by the concave face of the plate 3 and a top recess of the support frame 1. The cavity 48 is delimited by a bottom recess of the frame 1 and by a base plate 43 of insulating material which carries lead terminals 45 and the electronic components 44 of an impedance-matching circuit. The microphone unit is closed by means of a crimped-on metallic casing 40 which serves to clamp the support frames 1 and 2, the plate 3 and the circuit support plate 43 against each other. The upper support frame 2 serves as a ground electrode and the casing 40 provides electrostatic shielding. The lower support frame 1 is isolated from the casing 40 and is connected to the input of an amplifier. The response curve 50 of the microphone unit of FIG. 13 is given in FIG. 15. It is apparent that the shape of said response curve is very uniform and located well within the dimensional limits imposed for utilization in the field of telephone communications.

Figure 16:
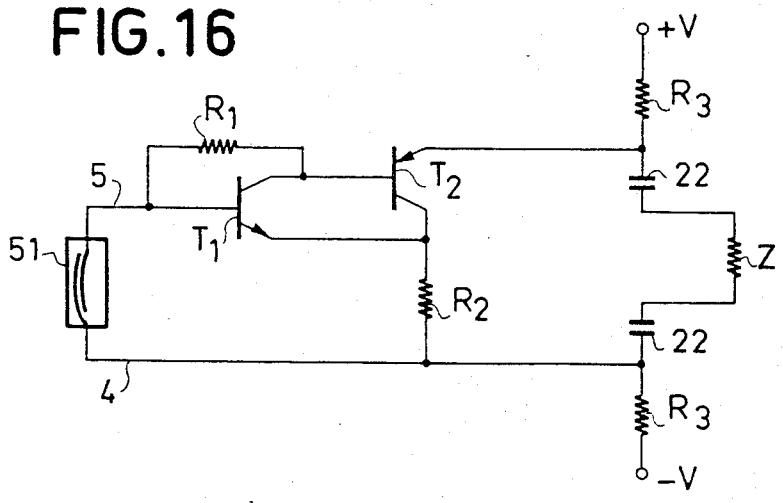
FIG. 16 is an electrical diagram of an impedance-matching circuit.

FIG. 16 is an electrical diagram of the impedance-matching circuit employed in conjunction with the microphone unit 51 of FIG. 13. This circuit comprises two dc-coupled amplifier stages. The first stage comprises an npn bipolar transistor $T_1$, the emitter of which is connected to a resistor $R_2$, one terminal of which is connected to ground electrode 4. A collector-base resistor $R_1$ serves to apply the current bias. The electrode 5 is connected to the base of the transistor $T_1$. The second amplifier stage comprises a pnp bipolar transistor $T_2$, the collector of which is connected to the emitter of the transistor $T_1$. The base of the transistor $T_2$ is connected to the collector of the transistor $T_1$ and its emitter is connected via a load resistor $R_3$ to the positive pole $+V$ of a supply source. The negative pole $-V$ of the supply source is connected to ground electrode 4 via another resistor $R_3$. The variable voltage drop produced between the emitter of the transistor $T_2$ and ground electrode 4 is transmitted to the transmission line Z via two coupling capacitors 22.

Figure 14:
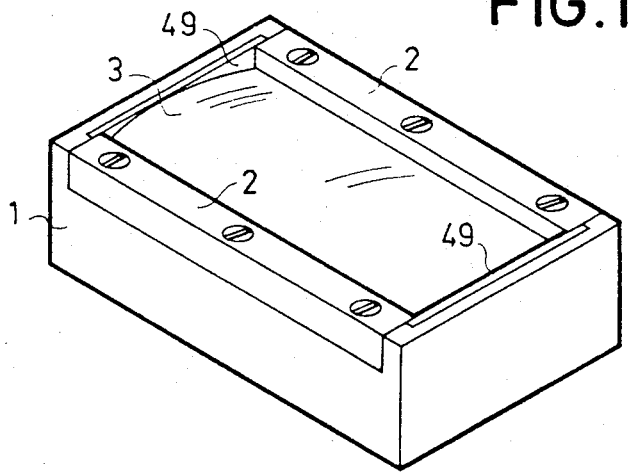
FIG. 14 is a view in isometric perspective showing a microphone unit which makes use of a curved plate.

As will be readily apparent, the invention is not limited in any sense to circular plates, the edges of which are clamped along their periphery. FIG. 14 is an isometric view of a microphone unit provided with a piezoelectric plate 3 of rectangular shape. The casing 1 has two opposite edges in cooperating relation with two longitudinal members 2 in order to form an insetting or edge-clamping joint which has the effect of giving a curved shape to the plate 3. The other two edges of the casing 1 are raised in order to retain the non-inset edges of the plate 3. Seals 49 of elastic foam line the raised edges of the casing 1 and insulate the concave face of the plate 3 from the action of the external acoustic pressure. In this case, the casing 1 has a rigid base and at least one internal cavity which is compressed by the vibration of the plate 3. In other words, the acoustic pressure on the plate causes a reduction in the volume of the internal cavity.

The invention is also applicable to microphone units of the pressure-gradient type. In this case the vibrating plate is set in a screen and this latter produces a differentiation.between the acoustic pressures acting upon the two faces. It is also possible to employ two piezoelectric plates set in a frame in order to enclose a volume of air. The electrical interconnection of these plates makes it possible to obtain a response characteristic of the pressure-gradient type in order to enhance near sound sources at the expense of remote sources.

The microphone described in the foregoing can advantageously be employed as a hydrophone with a first-resonance frequency reduced by the water pressure. In this case, the coupling between the vibrating element and the water medium can be effected by means of a coating of polyurethane, for example, this coating being chosen so as to have an acoustic impedance which is close to that of water.

What is claimed is:

1. An electroacoustic transducer of the piezoelectric polymer type comprising:

a vibrating element including at least one elastic structure made from a piezoelectric polymer in the form of a rigid plate, said rigid plate being subjected directly to acoustic pressure on at least one of its faces;

at least two electrodes forming a capacitor and one of said at least two electrodes being disposed on each face of said rigid plate;

an impedance-matching electric circuit connected to said at least two electrodes;

a casing containing said rigid plate and said electric circuit, said casing including a base having a wavy end surface, an annular clamping member having a mating wavy end surface for clamping said rigid plate to said base, and a pair of output terminals, wherein when said at least one face is subjected to acoustic pressure a sag is formed in the middle of said rigid plate and inflection points are formed on either side of said sag.

2. A transducer according to claim 1, wherein a resistor is connected between said electrodes in order to attenuate the sensitivity below a frequency which is lower than a first resonance frequency of said plate.

3. A transducer according to claim 1, wherein damping means are associated with said rigid plate for spreading a sensitivity peak corresponding to the first rigid resonance of said plate.

4. A transducer according to claim 1, wherein the acoustic pressure produces action on one face of said rigid plate so that said rigid plate decreases the volume of a closed internal space delimited by a rigid casing.

5. A transducer according to claim 2, wherein said resistor is a discrete element which is rigidly fixed to said rigid plate.

6. A transducer according to claim 2, wherein said resistor is distributed over the entire area of said rigid plate, said piezoelectric polymer being doped so as to be electrically conductive.

7. A transducer according to claim 1, said rigid plate having a diameter of 15 mm and a thickness of 200 microns.

8. An electroacoustic transducer of the piezoelectric polymer type comprising:

a vibrating element including at least one elastic structure made from a piezoelectric polymer in the form of a rigid plate, said rigid plate being subjected directly to acoustic pressure on at least one of its faces;

at least two electrodes forming a capacitor and one of said at least two electrodes being disposed on each face of said rigid plate;

an impedance-matching electric circuit connected to said at least two electrodes;

a casing containing said rigid plate and said electric circuit, said casing including a base having a first end surface, an annular clamping member having a mating second end surface for clamping said rigid plate to said base, said first and second end surfaces forming a frustoconical clamped-edge joint, and a pair of output terminals, wherein when said at least one face is subjected to acoustic pressure a sag is formed in the middle of said rigid plate and inflection points are formed on either side of said sag.

9. A transducer according to claim 8, wherein a resistor is connected between said electrodes in order to attenuate the sensitivity below a frequency which is lower than a first resonance frequency of said rigid plate.

10. A transducer according to claim 8, wherein damping means are associated with said rigid plate in order to spread the sensitivity peak corresponding to a first resonance frequency of said rigid plate.

11. A transducer according to claim 8, wherein the acoustic pressure produces action on one face of said rigid plate so that said rigid plate decreases the volume of compressing a closed internal space delimited by a rigid casing.

12. A transducer according to claim 8, wherein said resistor is a discrete element which is rigidly fixed to said rigid plate.

13. A transducer according to claim 9, wherein said resistor is distributed over the entire area of said rigid plate, said piezoelectric polymer being doped so as to be electrically conductive.

14. A transducer according to claim 8, said rigid plate having a diameter of 15 mm and a thickness of 200 microns.

* * * * *